US009447595B1

(12) United States Patent
Goettl

(10) Patent No.: US 9,447,595 B1
(45) Date of Patent: Sep. 20, 2016

(54) SYSTEMS, METHODS AND APPARATUSES FOR RELIEVING EXCESSIVE SUCTION WITHIN SWIMMING POOL SKIMMERS

(71) Applicant: GSG Holdings, Inc., Chandler, AZ (US)

(72) Inventor: John M Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 147 days.

(21) Appl. No.: 14/496,107

(22) Filed: Sep. 25, 2014

Related U.S. Application Data

(60) Provisional application No. 61/882,509, filed on Sep. 25, 2013.

(51) Int. Cl.
*E04H 4/16* (2006.01)

(52) U.S. Cl.
CPC ..... *E04H 4/16* (2013.01)

(58) Field of Classification Search
CPC ..... E04H 4/16
USPC ..... 210/167.1, 167.12, 167.19, 416.1, 210/416.2
See application file for complete search history.

(56) References Cited

U.S. PATENT DOCUMENTS

| | | | | |
|---|---|---|---|---|
| 5,830,350 | A | 11/1998 | Voss et al. | |
| 6,007,714 | A * | 12/1999 | Keith | B01D 29/15 210/167.12 |
| 6,022,481 | A | 2/2000 | Blake | |
| 7,300,576 | B1 | 11/2007 | Blake | |
| 7,563,365 | B2 | 7/2009 | Pellington et al. | |
| 8,721,881 | B1 * | 5/2014 | Smith | E04H 4/1272 210/167.1 |
| 2014/0263101 | A1 * | 9/2014 | Voss Weyman | E04H 4/1272 210/776 |

* cited by examiner

*Primary Examiner* — Fred Prince
(74) *Attorney, Agent, or Firm* — Booth Udall Fuller, PLC

(57) ABSTRACT

A pool skimmer system includes a skimmer housing and a basket. The skimmer housing includes a deck throat opening, a pool throat opening, a lower skimmer rim, an upper skimmer rim, a pump inlet port, a pool return port, and a pump suction port. The basket is positioned within the housing and includes a lower basket rim engaged with the lower skimmer rim, an upper basket rim engaged with the upper skimmer rim, porous walls, and a pool inlet opening proximate the pool throat opening. A fluid path is formed within the skimmer housing and extends from the pump suction port to the area between the one porous sidewall of the upper skimmer housing and the skimmer interior wall to allow fluid communication between the one or more suction ports and the upper basket rim.

20 Claims, 3 Drawing Sheets

SYSTEMS, METHODS AND APPARATUSES FOR RELIEVING EXCESSIVE SUCTION WITHIN SWIMMING POOL SKIMMERS

CROSS REFERENCE TO RELATED APPLICATIONS

This document claims the benefit of the filing date of U.S. Provisional Patent Application 61/882,509, entitled "Systems, Methods, and Apparatuses for Relieving Excessive Suction within Swimming Pool Skimmers" to Goettl which was filed on Sep. 25, 2013, the contents of which are hereby incorporated by reference.

BACKGROUND

1. Technical Field

Aspects of this document relate generally to pool skimmer systems.

2. Background Art

Most swimming pools have a skimming device connected to the suction of a pump to draw water from the pool at or very near the pool surface. These devices usually include a basket or strainer to separate larger debris such as leaves and other floating particles. Water drawn from the skimmer can be connected to the suction of a pump that is connected to a typical swimming pool filter system and returned back to the pool in one or more ordinary ways well known in the art. It is common to connect the suction of several pumps to a skimmer in order to enhance skimming action. There are skimmers commonly called Venturi skimmers, equipped with a pressure jet located to entrain water within the skimmer and eject it back to the pool through a relatively short unobstructed conduit. This method produces a significant flow increase through the skimmer resulting in improved surface debris entrapment.

Typically, the pump suction connected to a skimmer is also connected to one or more other drains within the pool. This provides protection to the skimmer basket should it become blocked by debris. The suction is simply diverted to the other drain thereby protecting the skimmer basket from deformation or bursting.

In the case of connecting pump suction to a skimmer only, the basket will usually fail when totally blocked by debris, resulting in the expense and labor of cleaning the system of debris and replacement of the damaged basket. In the case of a Venturi skimmer, when the debris basket becomes blocked, the Venturi return line becomes a point of suction that can be very dangerous to a bather. This is particularly true when the suction of a pump is also connected to a Venturi type skimmer as the flow through the Venturi return is reversed when the basket becomes full or otherwise blocked due to the suction of the separately attached pump.

There are skimming devices that provide air relief in an effort to solve the forgoing problems. U.S. Pat. No. 5,830,350 to Price describes a skimmer basket that has a central perforated pylon extending from the basket bottom to above the basket rim. The pylon consumes a portion of the basket capacity and is difficult to manufacture. U.S. Pat. No. 7,300,576 to Blake describes a conventional Venturi skimmer with an external tube running from the upper interior of the main skimmer body to a location below the skimmer basket in the main skimmer body. This method results in a necessarily small tube on the exterior of the skimmer which is very difficult to clean (due to the 90 degree turns involved) and costly to manufacture. Furthermore, the chance of damaging the skimmer during the construction process is increased due to its exterior nature.

SUMMARY

According to one aspect, a pool skimmer system comprises a skimmer housing, a basket, and a fluid path. The skimmer housing comprises a pool throat opening having an upper wall and a lower wall, a deck throat opening, a basket opening, a lower skimmer rim proximate the basket opening, an upper skimmer rim on a skimmer interior wall of the skimmer housing at an elevation at least halfway between the upper wall and the lower wall, and one or more pump suction ports. The basket is operably positioned within the housing and comprises a lower basket rim engaged with the lower skimmer rim, an upper basket rim engaged with the upper skimmer rim, a porous basket bottom opposite the upper basket rim, a lower basket portion comprising one or more continuous porous sidewalls positioned between the lower rim and the porous basket bottom, and an upper basket portion comprising a porous sidewall extending between the lower basket rim and the upper basket rim and a pool inlet opening extending between the lower basket rim and the upper basket rim and aligned with the pool throat opening. The fluid path extends from the one or more suction ports to the upper basket rim.

Various implementations and embodiment may comprise one or more of the following. The upper skimmer rim may comprise one or more air slots extending therethrough and is positioned proximate the pool deck opening above upper wall of the pool throat opening such that the fluid path extends from the air slots positioned above the upper wall of the pool throat opening to the one or more suction ports. A pump inlet port on the skimmer housing, a pool return port on the skimmer housing, and two basket side rims extending between the upper basket rim and the lower basket rim, wherein the lower rim is adjacent the pool inlet opening and extends only between the two basket side rims and wherein the air slots are positioned on the upper basket rim adjacent the porous basket sidewall of the upper basket portion. The two basket side rims may be positioned adjacent two terminating ends of the porous sidewall of the upper basket portion. The two basket side rims may be substantially vertical and positioned approximately 180 degrees from one another. The two basket side rims may be substantially vertical and positioned less than 180 degrees from one another. The two basket side rims may be substantially vertical and positioned greater than 180 degrees from one another. The two basket side rims may be angled such that an upper end of the pool inlet opening is approximately 180 degrees and a lower end of the pool inlet opening is less than 180 degrees.

According to another aspects, a pool skimmer system comprises a skimmer housing and a basket. The skimmer housing comprises an upper skimmer housing and a lower skimmer housing. The upper skimmer housing comprises a pool throat opening having an upper wall and a lower wall, a deck throat opening, a first basket opening, a lower skimmer rim proximate the first basket opening, and an upper skimmer rim on a skimmer interior wall of the upper skimmer housing at an elevation at least halfway between the upper wall and the lower wall. The lower skimmer housing comprises a second basket opening aligned with the first basket opening and one or more pump suction ports. This basket is sized to mount within the first and second basket openings and comprises a lower basket rim configured to engage with the lower skimmer rim when the basket is mounted within the first and second basket openings, an upper basket rim configured to engage with the upper skimmer rim when the basket is mounted within the first and second basket openings, a porous basket bottom opposite the upper basket rim, a lower basket portion comprising one or more continuous porous sidewalls positioned between the lower rim and the porous basket bottom, and an upper basket portion comprising a porous sidewall extending between the lower basket rim and the upper basket rim and a pool inlet opening extending between the lower basket rim and the upper basket rim.

Various implementations and embodiments may comprise one or more of the following. The upper skimmer rim may comprise one or more air slots extending therethrough and may be positioned proximate the pool deck opening above upper wall of the pool throat opening. The lower skimmer housing may comprise a pump inlet port and a pool return port. Two basket side rims extending between the upper basket rim and the lower basket rim, wherein the lower rim of the basket is adjacent the pool inlet opening and extends only between the two basket side rims and wherein the air slots are positioned on the upper basket rim adjacent the porous basket sidewall of the upper basket portion. The two basket side rims may be positioned adjacent two terminating ends of the porous sidewall of the upper basket portion. The two basket side rims may be substantially vertical and positioned approximately 180 degrees from one another. The two basket side rims may be substantially vertical and positioned less than 180 degrees from one another. The two basket side rims may be substantially vertical and positioned greater than 180 degrees from one another. The two basket side rims may be angled such that an upper end of the pool inlet opening is approximately 180 degrees and a lower end of the pool inlet opening is less than 180 degrees.

According to another aspect, a pool skimmer basket comprises a lower basket rim, an upper basket rim, a porous basket bottom opposite the upper basket rim, a lower basket portion comprising one or more continuous porous sidewalls positioned between the lower rim and the porous basket bottom, and an upper basket portion comprising a porous sidewall extending between the lower basket rim and the upper basket rim and a pool inlet opening extending between the lower basket rim and the upper basket.

Various implementations and embodiment of the pool skimmer basket may comprise one or more of the following. One or more air slots extending through the upper basket rim. Two basket side rims extending between the upper basket rim and the lower basket rim, wherein the lower rim of the basket is adjacent the pool inlet opening and extends only between the two basket side rims and wherein the air slots are positioned on the upper basket rim adjacent the porous basket sidewall of the upper basket portion. The two basket side rims may be positioned adjacent two terminating ends of the porous sidewall of the upper basket portion and may be substantially vertical. The two basket side rims may be positioned adjacent two terminating ends of the porous sidewalls of the upper basket portion and may be angled such that an upper end of the pool inlet opening is approximately 180 degrees and a lower end of the pool inlet opening is less than 180 degrees.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool skimmer systems and/or assembly procedures for pool skimmer systems will become apparent for use with implementations of pool skimmer systems from this disclosure. Accordingly, for example, although particular pool skimmer systems are disclosed, such pool skimmer systems and implementing components may comprise any shape, size, style, type, model, version, measurement, concentration, material, quantity, and/or the like as is known in the art for such pool skimmer systems and implementing components, consistent with the intended operation of pool skimmer systems.

Figure 1:
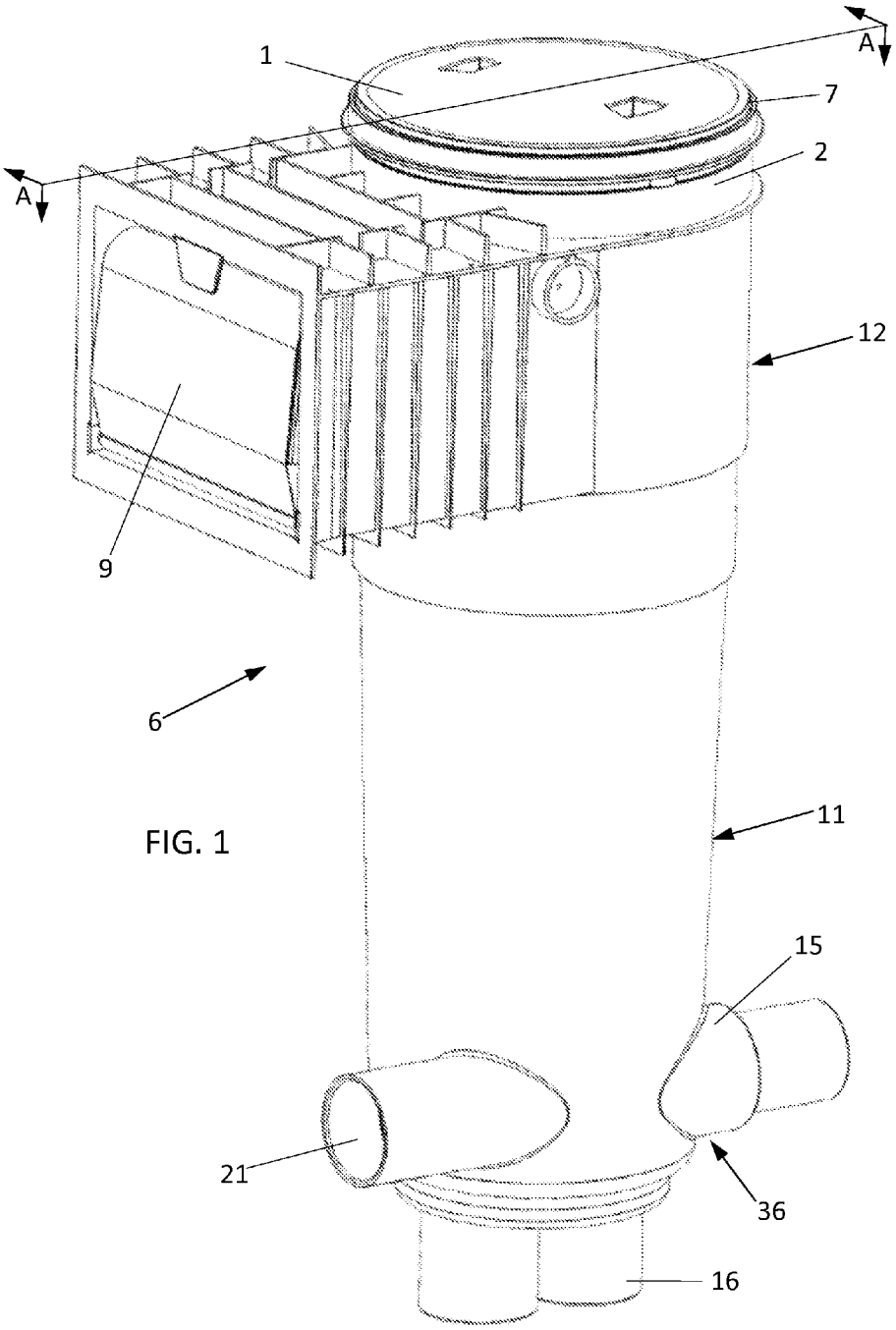
FIG. 1 is a perspective view of a pool skimmer housing.

FIG. 1 depicts a non-limiting embodiment of a pool skimmer housing. Reference is made throughout this document to an upper skimmer housing 12 and a lower skimmer housing 11. It is contemplated that the upper skimmer housing 12 and the lower skimmer housing 11 may comprise two separate and individual pieces coupled together, or a single piece integrally formed during manufacture, whether formed as two separate pieces or as one piece, the respective areas of the skimmer housing will be referred to as upper skimmer housing 12 and lower skimmer housing 11. In the particular non-limiting embodiment depicted in FIGS. 1 and 2, the upper skimmer housing 12 and the lower skimmer housing 11 comprise two separate pieces coupled together. It is further contemplated embodiments of a pool skimmer system 6 in general and a pool skimmer housing referenced in this document may comprise various features of a pool skimmer housing previously known in the art, such as but not limited to a pool throat opening 3 having an upper wall 17 and a lower wall 18, a weir 9 hingedly or otherwise pivotally coupled to the upper skimmer housing 12 proximate a pool throat opening 3, a deck closure or cover 1 coupled to the upper skimmer housing 12 proximate a deck throat opening 5, one or more pump suction ports 16 on a bottom 20 of the lower skimmer housing 11, a finish edge 7, a skimmer interior wall 4, a deck ring 2, and the like. In one or more embodiments, the pool surface elevation is approximately ½ of skimmer throat opening, or halfway between the upper wall 17 and the lower wall 18 of the pool throat opening 3. However, the pool elevation can vary from upper elevation at the upper wall 17 to a lower elevation at the lower wall 18 due to increased bather influx, rain, insufficient make up water, and other reasons known in the art. Some skimmer embodiments are adapted with an overflow port 19 to limit and provide an attachment point of piping to carry away overflow to a suitable area away from the pool. Normally, the maximum water containing height of a pool is approximately upper elevation at the upper wall 17.

The skimmer housing may comprise a basket opening positioned within the pool skimmer housing. The basket opening is sized to house a basket 10 and allow a fluid path 31 between the basket 10 and the skimmer interior wall 4, as shall be described in greater detail below. To facilitate housing of the basket 10 within the skimmer housing, the upper skimmer housing 12 comprises a first basket opening 41 and the lower skimmer housing 11 comprises a second basket opening 42 aligned with the first basket opening 41.

Additionally, the lower skimmer housing 11 may comprise a venturi system 36. The venturi system typically comprises a pump inlet port 15 having a venturi nozzle 13 coupled thereto and a pool return port 21 having a venturi sleeve 14 coupled thereto. The venturi system 36 may operate as is known to those having ordinary skill in the art. For example, a pool pump associated with the system may pull water in the skimmer housing into the one or more pump suction ports 16 or any other suction ports known in the art, push water into the skimmer housing through the pump inlet port 15, and push water into the pool return port 21 to return filtered water back into the pool and create a high velocity flow to entrain water in the skimmer housing, thereby creating an increased flow through the skimmer. The one or more conventional pump suction ports 16 are configured for connection of additional pump or pump suction and drain connection in the conventional manner.

In one or more embodiments, the pool skimmer housing comprises a lower skimmer rim 30 and an upper skimmer rim 28. The lower skimmer rim 30 is configured to engage with the lower basket rim 27 of the basket 10 when the basket 10 is mounted in the skimmer housing. The lower skimmer rim 30 is positioned proximate the first basket opening 41 in some embodiments. More particularly, the lower skimmer rim 30 may be positioned at an elevation that is similar to or lower than the lower wall 18 of the pool throat opening 3. In the non-limiting embodiment depicted in FIG. 2, the lower skimmer rim 30 is positioned substantially level with the lower wall 18 of the pool throat opening 3, being lowered just enough that the lower basket rim 27 is level with the lower wall 18 of the pool throat opening 3 when the basket 10 is mounted within the skimmer housing. In other embodiments, the lower skimmer rim 30 is positioned below the elevation or level of the lower wall 18 of the pool throat opening 3. According to some aspects, the lower skimmer rim 30 is positioned in a portion of the skimmer interior wall 4 nearest the pool throat opening 3. This positioning prevents the lower skimmer rim 30 from interfering with the fluid path 31 between the air slots 33 and the one or more pump suction ports 16. In other embodiments, however, the lower skimmer rim 30 may be positioned anywhere on the skimmer interior wall 4 so long as a fluid path 31 is not significantly blocked. More particularly, at least a portion of the lower skimmer rim 30 may be positioned on a portion of the skimmer interior wall 4 opposite the pool throat opening 3 in embodiments wherein the lower basket rim 27 comprises one or more air slots 33.

According to some aspects, the upper skimmer rim 28 is positioned on a skimmer interior wall 4 of the upper skimmer housing 12 at an elevation 8 that is at least halfway between the upper wall 17 and the lower wall 18 of the skimmer throat opening 3. The upper skimmer rim 28 is configured to engage with the upper basket rim 25 of the basket 10 when the basket 10 is mounted in the skimmer housing. In the non-limiting embodiment depicted in FIG. 2, the upper skimmer rim 28 is positioned at an elevation that is substantially level with the upper wall 17 of the pool throat opening 3. In this configuration, the upper skimmer rim 28 is positioned proximate the pool deck opening 5 at an elevation wherein the air slots 33 will always be above the pool water level. This ensures the safety of the venturi system, as described in greater detail below. The air slots 33, however, are not required in all embodiments to provide some of the advantages described herein.

One or more embodiments of a skimmer housing comprise two skimmer side rims 29 extending at least partially between the upper skimmer rim 28 and the lower skimmer rim 30. The skimmer side rims 29 are configured and positioned within the upper skimmer housing 12 to engage with the basket side rims of the basket 10 to prevent or otherwise inhibit pool water from flowing between the basket 10 and the skimmer side rims 29 when the basket 10 is mounted within the skimmer housing. The skimmer side rims 29 may be substantially vertical or angled complementary to the positioned of the basket side rims 26.

Figure 2:
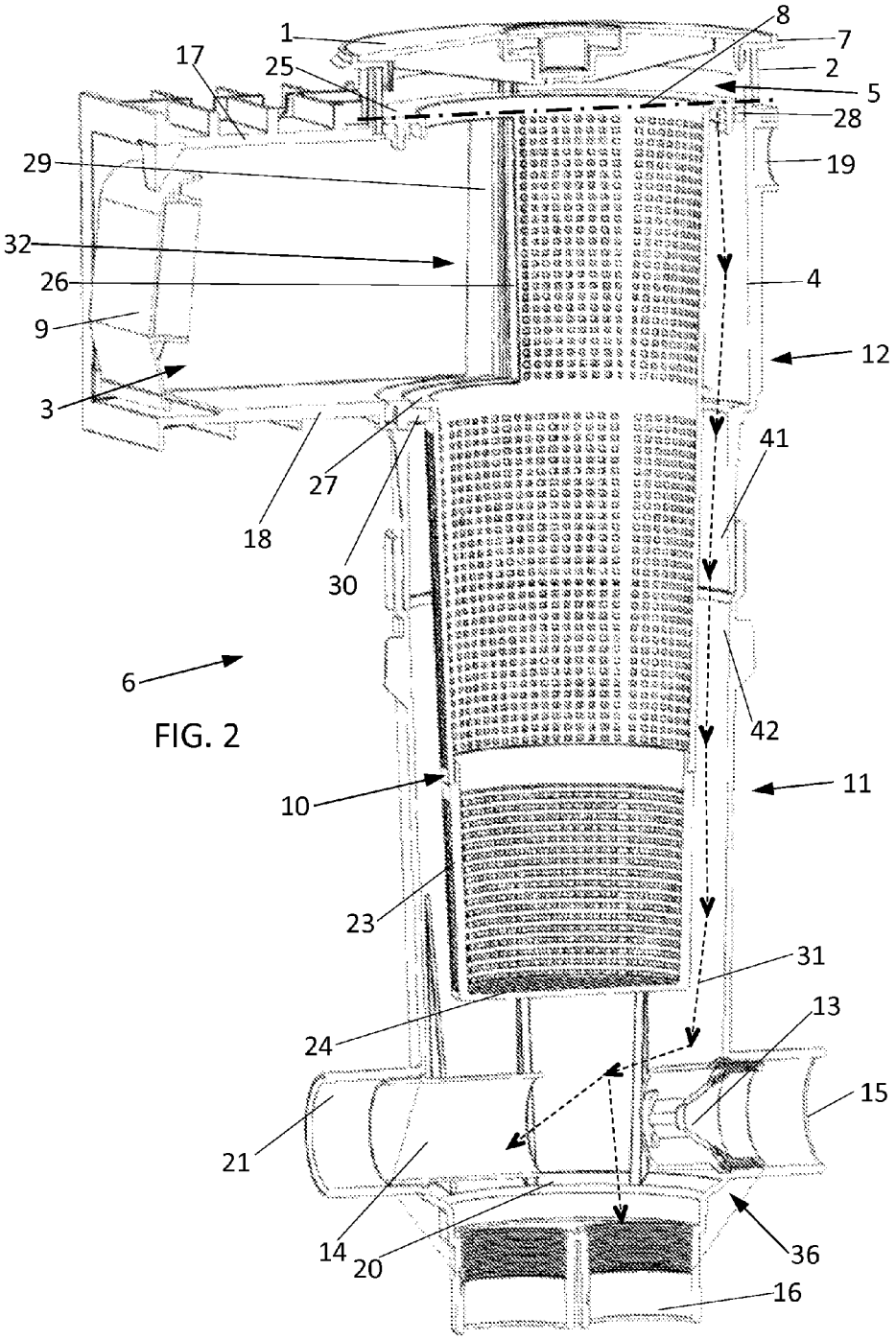
FIG. 2 is a perspective view of a pool skimmer housing and basket taken along sectional line A-A of FIG. 1.
Figure 3:
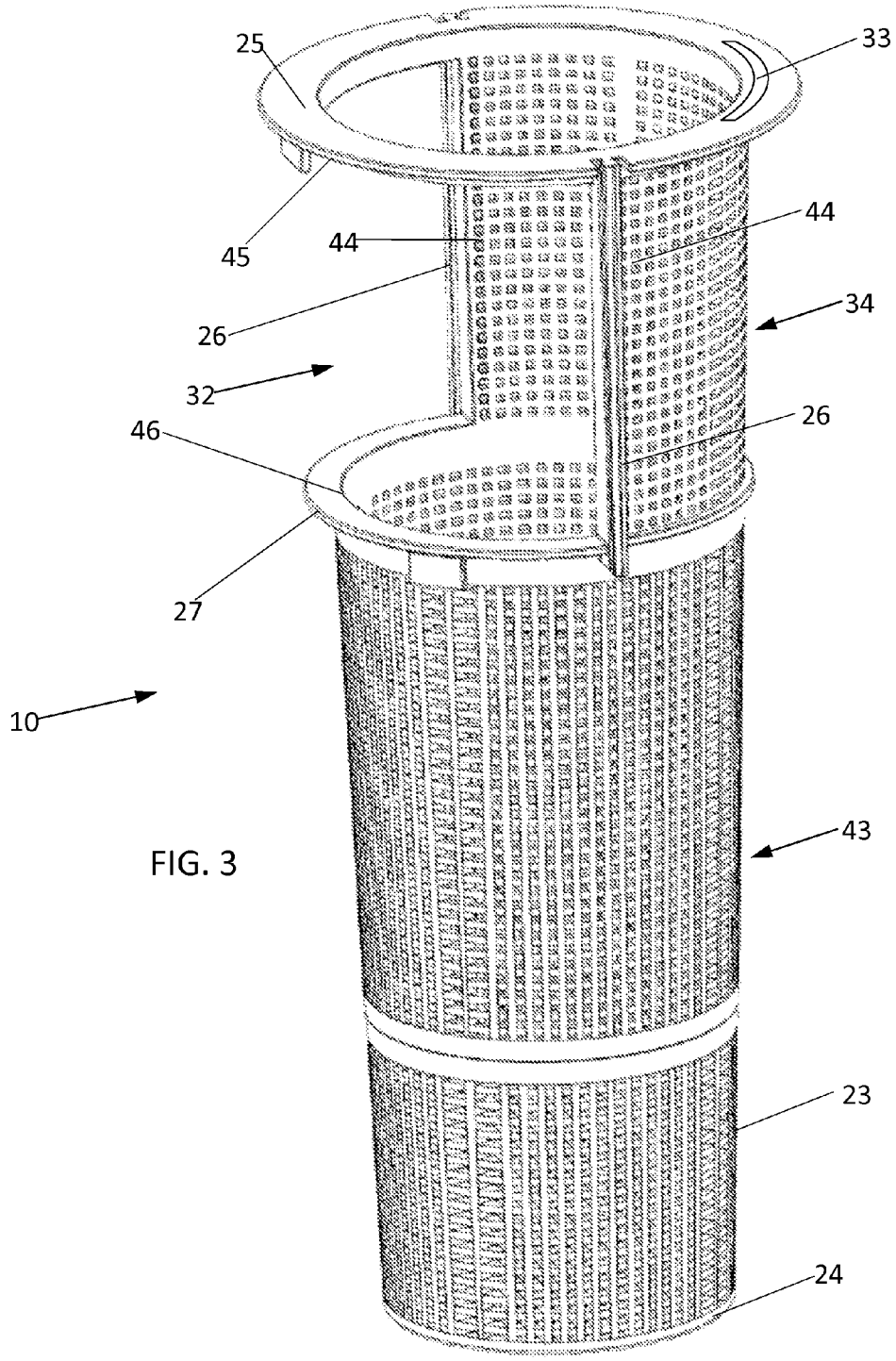
FIG. 3 is a perspective view of a basket.

Also contemplated in this disclosure is a skimmer basket 10 for use in a pool skimmer system 6. The basket 10 is advantageous to conventional skimmer baskets because, in combination with the configuration of the skimmer housing, a fluid path 31 is formed between the porous walls 23 of the basket and the skimmer interior wall 4. FIG. 2 depicts a cross sectional view of a non-limiting embodiment of a basket 10 mounted within a pool skimmer housing and FIG. 3 depicts a non-limiting embodiment of a basket 10. According to some aspects, a basket 10 is sized and shaped to fit within the pool skimmer housing, an may be either a conical or frusto-conical shape.

Similar to conventional skimmer baskets, a skimmer basket 10 comprises an open top, a porous bottom 24, and one or more porous sidewalls 23. In conventional skimmer baskets, however, the porous walls extend continuously from the top of the basket to the bottom of the basket. Advantageously, one or more embodiments of a basket 10 contemplated in this disclosure comprise a pool inlet opening 32 positioned between the upper basket rim 25 and the porous sidewalls 23. More particularly, one or more embodiments of a basket 10 comprise an upper basket portion 34 extending between an upper basket rim 25 and a lower basket rim 27, and a lower basket portion 43 extending between the lower basket rim 27 and the porous bottom 24 of the basket. In the lower basket portion 43, the one or more porous sidewalls 23 typically extend entirely around the circumference of the basket 10. In the upper basket portion 34, the one or more porous sidewalls 23 extend only partially around the circumference of the basket 10, with a pool inlet opening 32 interrupting the continuity of the porous sidewall 23. The pool inlet opening 32 may be bordered by the upper basket rim 25, the lower basket rim 27, and two basket side rims 26 that extend from the lower basket rim 27 to the upper basket rim 25 in some embodiments. Similarly, the porous wall 23 of the upper basket portion 34 may comprise two terminating ends 44 proximate the two basket side rims 26 and may extend from the upper basket rim 25 to a position level with the lower basket rim 27.

According to some aspects, the basket side rims 26 may be substantially vertical or angled between the lower basket rim 27 and the upper basket rim 25. In the non-limiting embodiment depicted in FIGS. 2 and 3, the basket side rims 26 are substantially vertical. In such embodiments, an upper end 45 of the pool inlet opening 32 and a lower end 46 of the pool inlet opening are substantially equal in the degree of opening. For example, in the non-limiting embodiment depicted in FIGS. 2 and 3, the basket side rims 26 are positioned approximately 180 degrees from another at both the upper end 45 and the lower end 46 of the pool inlet opening 32. In other embodiments, the basket side rims 26 are substantially vertically but positioned more or less than 180 degrees from one another to increase or decrease, respectively, the size of the pool inlet opening 32.

In embodiments wherein the basket side rims 26 are angled, the upper end 45 and lower end 46 of the pool inlet opening are not equal in the degree of opening. For example, the basket side rims 26 may be angled such that the degree of opening on the upper end 45 is greater than the degree of opening on the lower end 46 of the pool inlet opening 32. Alternatively, the basket side rims 26 may be angled such that the degree of opening on the upper end 45 is less than the degree of opening on the lower end 46 of the pool inlet opening 32. Even more particularly, the two basket side rims 26 may be angled such that an upper end 45 of the pool inlet opening 32 is open for at least 180 degrees and a lower end 46 of the pool inlet opening 32 is open for less than 180 degrees. The resulting angle of the two side basket rims 26 may, then, be angled at an angle with respect to the lower wall 18 of the pool throat opening 3 of anywhere between approximately 45 degrees and 90 degrees.

When mounted within the skimmer housing, pool inlet opening 26 of the basket 10 is positioned facing the pool throat opening 3 of the upper skimmer housing 12 in some embodiments, with the porous sidewall 23 of the upper basket portion 34 positioned opposite the pool throat opening 3. In this position, water entering the pool throat opening 3 from the pool flows through the pool inlet opening 32 into the basket 10. Moreover, the basket side rims 26, the lower basket rim 27, and the upper basket rim 25 prevent or inhibit pool water from entering the first basket opening 41 and the second basket opening 42 except through the porous walls 23 of the basket 10. The width of the skimmer throat 3 and a diameter of the basket 10 are ideally and generally equal or approximately equal. They may, however, comprise any dimensional combination. In particular embodiments, the height of pool inlet opening 32 is substantially equal to the distance from the upper skimmer rim 28 to the lower skimmer rim 30. In this way, debris and water will flow into the basket 10 when the pool level is within a range from the upper pool level and the lower pool level.

The lower basket rim 27 of the basket 10 divides the lower basket portion 43 from the upper basket portion 34 in some embodiments and is configured to engage with the lower skimmer rim 30 when the basket 10 is mounted within the skimmer housing (shown in FIG. 2). The lower basket rim 27 may extend only between the basket side rims 26 proximate the pool inlet opening 32 or, alternatively, may extend entirely around the circumference of the basket 10. In embodiments wherein the lower basket rim 27 extends entirely around the circumference of the basket 10, the lower basket comprises one or more air slots between the basket side rims 26 and proximate the porous sidewall 23 of the upper basket portion 34.

The upper basket rim 25 of the basket 10 is positioned at or proximate a top of the basket 10 in one or more embodiments and is configured to engage with the upper skimmer rim 28 when the basket 10 is mounted within the skimmer housing (shown in FIG. 2). When positioned within the skimmer housing, the upper basket rim 25 is positioned at an elevation 8 that is at least halfway between the lower wall 18 and the upper wall 17 of the pool throat opening 3. More particularly, when positioned within the housing, the upper basket rim 25 may be positioned above deck throat opening 5 at or above the level of the upper wall 17 of the pool throat opening. The upper basket rim 25 may extend only between the basket side rims 26 opposite the pool inlet opening 32 or, alternatively, may extend entirely around the circumference of the basket 10. In the non-limiting embodiment depicted in FIGS. 2 and 3, the upper basket rim 25 extends entirely around the circumference of the basket 10. The upper basket rim 25 comprises one or more air slots 33 or passages. The one or more air slots 33 are positioned on the upper basket rim 25 such that when the upper basket rim 24 is engaged with the upper skimmer rim 28, the upper skimmer rim 28 does not cover or block the one or more air slots 33. The one or more air slots 33 may be positioned only between the two basket side rims 26 proximate the porous sidewall 23 or, alternatively, around the entirety of the upper basket rim 25.

As depicted in the non-limiting embodiment of FIG. 2, when a basket 10 is mounted within a pool skimmer housing, a fluid path 31 that extends between the one or more pump suction ports 16 and the air slots 33 of the upper basket rim 25 is formed. Air slots 33 are deposed in the upper basket rim 25 in some embodiments to allow atmospheric or fluid communication with fluid path 31, even when pool level is at the upper wall 17 of the pool throat opening 3. Thus, the upper basket rim 25 and a porous wall 23 of the upper portion 34 of the basket 10 is above the normal water level of the pool in one or more embodiments. The normal water level is usually maintained approximately midway between upper wall 17 and lower wall 18 of the pool throat opening 3. As depicted in FIG. 2, the upper basket portion 34 provides additional straining capacity over conventional skimmer devices. The additional porous area added to the basket 10 by the additional area extended to the top of the throat height where the additional basket area only surrounds half of the throat is $(D*\pi*H)/2$, where D equals the diameter of the basket 10 and H equals the height of the basket 10 above the lower rim 27 in FIG. 2. For example, in a non-limiting embodiment, a typical skimmer basket 10 may have a diameter of approximately 7.5 inches. Assuming the pool is at a normal water level 8 that is three inches above the lower rim 27, the additional porous area under water would be: $(7.5*3.14*3)/2=35.3$ sq inches. Furthermore, the additional total porous area, assuming the upper basket portion 34 extends to the top of the skimmer throat opening 3, would be: $(7.5*3.14*6)/2=70.7$ sq inches. In this way, dangerous over suction is prevented by allowing atmosphere to enter any part of the upper basket portion 34, the air slots 33, or the skimmer throat 3 that are positioned at least partially above the water level of the pool.

It would be understood by those skilled in the art that leaves and other debris being drawn into a pool throat opening 3 from the pool is trapped in the basket 10 and then generally drawn to an inner basket surface. Debris may continue to collect against the inner basket surface until all of the inner basket surface is covered, thus preventing water from flowing through the porous walls 23 and porous bottom 24 of the basket 10 and into the interior flow path. At this point, a vacuum is created in the skimmer housing by the conventional pump suction port(s) 16 and/or the venturi system 36. The vacuum may be great enough to deform conventional baskets of the prior art. In the case of the pump suction being connected to conventional port(s) 16 and venturi system 36, the flow is reversed by pump suction and causes a dangerous suction condition at pool return port 21.

Advantageous to conventional pool skimmer systems, it is apparent with the elements of embodiments of the skimmer that the above described over suction condition cannot occur as air is allowed to enter one or more air slots 33 in the upper basket portion 34 above pool level. The highest possible vacuum in skimmer interior 4 is limited to water depth between the pool return port 21 at the water level, which would normally not exceed 24 inches. As pump suction ports 16 or the venturi system 36 draw water from skimmer housing interior upon activation of the pump suction, air will be drawn into pump suction ports 16 and/or the venturi system 36, thereby causing the suction pump (not shown) to draw in air and ultimately cease suction operation. When pump suction at a pump suction port 16 ceases, any reversing of venturi 36 and the resultant dangerous suction at pool return port 21 will cease, or be limited, to the approximate 24 inch or approximate 2 foot water depth.

It is evident that current invention overcomes the disadvantages by eliminating external tubing and allowing for easier maintenance. It is also apparent that if the basket is not installed the skimmer would employ the same safety features as described. It is apparent that the upper skimmer housing 12 and lower skimmer housing 11 could be adapted to fit only basket 10 of current disclosure to prevent unapproved baskets from being used. The upper rim 25 may also be adapted to form a handle for improved ease of removal of basket 10 for periodic cleaning without submerging hands in water as with prior art devices. The additional upper basket portion 34 provides additional straining capacity while providing the safety features previously described.

It will be understood that implementations are not limited to the specific components disclosed herein, as virtually any components consistent with the intended operation of a method and/or system implementation for a pool skimmer system may be utilized. Accordingly, for example, although particular housings, baskets, ports, pumps, and the like may be disclosed, such components may comprise any shape, size, style, type, model, version, class, grade, measurement, concentration, material, weight, quantity, and/or the like consistent with the intended operation of a method and/or system implementation for a pool skimmer system may be used.

In places where the description above refers to particular implementations of a pool skimmer system, it should be readily apparent that a number of modifications may be made without departing from the spirit thereof and that these implementations may be applied to other pool skimmer systems. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool skimmer system, comprising:

a skimmer housing comprising a pool throat opening having an upper wall and a lower wall, a deck throat opening, a basket opening, a lower skimmer rim proximate the basket opening, an upper skimmer rim on a skimmer interior wall of the skimmer housing at an elevation at least halfway between the upper wall and the lower wall, and one or more pump suction ports;

a basket positioned within the housing and comprising a lower basket rim engaged with the lower skimmer rim, an upper basket rim engaged with the upper skimmer rim, a porous basket bottom opposite the upper basket rim, a lower basket portion comprising one or more continuous porous sidewalls positioned between the lower rim and the porous basket bottom, and an upper basket portion comprising a radially discontinuous porous sidewall extending between the lower basket rim and the upper basket rim and bordered by a basket side rim on each lateral side, the two basket side rims each extending from the lower basket rim to the upper basket rim, and a pool inlet opening between the side rims, the lower basket rim and the upper basket rim and aligned with the pool throat opening; and a fluid continuous path outside the lower basket porous sidewall and the upper basket porous sidewall that extends from the one or more suction ports to the upper basket rim.

2. The pool skimmer system of claim 1, wherein the upper skimmer rim comprises one or more air slots extending therethrough and is positioned proximate the pool deck opening above upper wall of the pool throat opening such that the fluid path extends from the air slots positioned above the upper wall of the pool throat opening to the one or more suction ports.

3. The pool skimmer system of claim 2, further comprising:

a pump inlet port on the skimmer housing;

a pool return port on the skimmer housing; and wherein the lower rim is adjacent the pool inlet opening and extends only between the two basket side rims and wherein the air slots are positioned on the upper basket rim adjacent the porous basket sidewall of the upper basket portion.

4. The pool skimmer system of claim 3, wherein the two basket side rims are positioned adjacent two terminating ends of the porous sidewall of the upper basket portion.

5. The pool skimmer system of claim 4, wherein the two basket side rims are substantially vertical and positioned approximately 180 degrees from one another.

6. The pool skimmer system of claim 4, wherein the two basket side rims are substantially vertical and positioned less than 180 degrees from one another.

7. The pool skimmer system of claim 4, wherein the two basket side rims are substantially vertical and positioned greater than 180 degrees from one another.

8. The pool skimmer system of claim 4, wherein the two basket side rims are angled such that an upper end of the pool inlet opening is approximately 180 degrees and a lower end of the pool inlet opening is less than 180 degrees.

9. A pool skimmer system, comprising:

a skimmer housing comprising:

an upper skimmer housing comprising a pool throat opening having an upper wall and a lower wall, a deck throat opening, a first basket opening, a lower skimmer rim proximate the first basket opening, and an upper skimmer rim on a skimmer interior wall of the upper skimmer housing at an elevation at least halfway between the upper wall and the lower wall; and a lower skimmer housing comprising a second basket opening aligned with the first basket opening and one or more pump suction ports; and a basket sized to mount within the first and second basket openings and comprising a lower basket rim configured to engage with the lower skimmer rim when the basket is mounted within the first and second basket openings, an upper basket rim configured to engage with the upper skimmer rim when the basket is mounted within the first and second basket openings, a porous basket bottom opposite the upper basket rim, a lower basket portion comprising one or more continuous porous sidewalls positioned between the lower rim and the porous basket bottom, and an upper basket portion comprising a porous sidewall extending between the lower basket rim and the upper basket rim and a pool inlet opening extending between the lower basket rim and the upper basket rim.

10. The pool skimmer system of claim 9, wherein the upper skimmer rim comprises one or more air slots extending therethrough and is positioned proximate the pool deck opening above upper wall of the pool throat opening, and wherein the lower skimmer housing comprises a pump inlet port and a pool return port.

11. The pool skimmer system of claim 10, further comprising two basket side rims extending between the upper basket rim and the lower basket rim, wherein the lower rim of the basket is adjacent the pool inlet opening and extends only between the two basket side rims and wherein the air slots are positioned on the upper basket rim adjacent the porous basket sidewall of the upper basket portion.

12. The pool skimmer system of claim 11, wherein the two basket side rims are positioned adjacent two terminating ends of the porous sidewall of the upper basket portion.

13. The pool skimmer system of claim 12, wherein the two basket side rims are substantially vertical and positioned approximately 180 degrees from one another.

14. The pool skimmer system of claim 12, wherein the two basket side rims are substantially vertical and positioned less than 180 degrees from one another.

15. The pool skimmer system of claim 12, wherein the two basket side rims are substantially vertical and positioned greater than 180 degrees from one another.

16. The pool skimmer system of claim 12, wherein the two basket side rims are angled such that an upper end of the pool inlet opening is approximately 180 degrees and a lower end of the pool inlet opening is less than 180 degrees.

17. A pool skimmer basket, comprising:

a lower basket rim;

an upper basket rim;

a porous basket bottom opposite the upper basket rim;

a lower basket portion comprising one or more continuous porous sidewalls positioned between the lower rim and the porous basket bottom; and an upper basket portion comprising a porous sidewall extending between the lower basket rim and the upper basket rim, the upper basket porous sidewall being radially discontinuous and radially bordered by two side rims each extending from the lower basket rim to the upper basket rim, and a pool inlet opening between the lower basket rim and the upper basket rim between the two side rims.

18. The pool skimmer basket of claim 17, further comprising one or more air slots extending through the upper basket rim; and wherein the lower rim of the basket is adjacent the pool inlet opening and extends only between the two basket side rims and wherein the air slots are positioned on the upper basket rim adjacent the porous basket sidewall of the upper basket portion.

19. The pool skimmer basket of claim 18, wherein the two basket side rims are positioned adjacent two terminating ends of the porous sidewall of the upper basket portion.

20. The pool skimmer basket of claim 18, wherein the two basket side rims are positioned adjacent two terminating ends of the porous sidewalls of the upper basket portion and are angled such that an upper end of the pool inlet opening is approximately 180 degrees and a lower end of the pool inlet opening is less than 180 degrees.

* * * * *